US009523553B2

(12) United States Patent
Sharron et al.

(10) Patent No.: US 9,523,553 B2
(45) Date of Patent: Dec. 20, 2016

(54) SWIVEL LOCK

(71) Applicants: Matthew A. Sharron, Seymour, CT (US); Andrew Visinski, Seymour, CT (US)

(72) Inventors: Matthew A. Sharron, Seymour, CT (US); Andrew Visinski, Seymour, CT (US)

( * ) Notice: Subject to any disclaimer, the term of this patent is extended or adjusted under 35 U.S.C. 154(b) by 0 days.

(21) Appl. No.: 14/870,403

(22) Filed: Sep. 30, 2015

(65) Prior Publication Data

US 2016/0097611 A1 Apr. 7, 2016

Related U.S. Application Data

(60) Provisional application No. 62/058,225, filed on Oct. 1, 2014.

(51) Int. Cl.
*F41C 27/00* (2006.01)
*F41G 11/00* (2006.01)

(52) U.S. Cl.
CPC ..... *F41C 27/00* (2013.01); *F41G 11/003* (2013.01); *F41G 11/006* (2013.01)

(58) Field of Classification Search
None
See application file for complete search history.

(56) References Cited

U.S. PATENT DOCUMENTS 5,992,076 A * 11/1999 Magnusson ..... F41A 17/36 42/70.11
7,222,451 B2 * 5/2007 Keng ..... F41A 23/08 42/127
7,886,476 B1 * 2/2011 Swan ..... F41C 27/00 403/374.5
8,438,965 B2 * 5/2013 Collin ..... F41G 11/003 89/125
8,833,117 B2 * 9/2014 Yang ..... E05B 37/025 70/14

* cited by examiner

*Primary Examiner* — Stephen M Johnson
(74) *Attorney, Agent, or Firm* — Buckingham, Doolittle & Burroughs, LLC

(57) ABSTRACT

An improved device for enabling a user to quickly and securely attach and detach an accessory (e.g., a scope, light, bayonet, etc.) to the Picatinny or tactical rail of a firearm. In a preferred embodiment of the present invention, a locking pin, in mechanical conjunction with a spring and a locking disk, cause a key to engage with a select channel of a Picatinny rail while a forward and rear fence of the present invention engage the rail flanges of said Picatinny rail. The device is relatively inexpensive to manufacture and safe and easy to use.

17 Claims, 8 Drawing Sheets

SWIVEL LOCK

CROSS-REFERENCE

This application claims priority from Provisional Patent Application Ser. No. 62/058,225 filed Oct. 1, 2014.

FIELD OF THE INVENTION

This invention relates to a swivel lock for mounting accessories (e.g., a scope, light, bayonet, etc.) on the Picatinny or tactical rail of a firearm.

BACKGROUND

Many individuals and firearm enthusiasts desire to mount one or more interchangeable accessories, such as a scope, light, bayonet and the like, onto their firearms. Historically, this has been accomplished by fixedly mounting the accessory to the Picatinny or tactical rail of the firearm, which is essentially a bracket that can be attached to a firearm and which provides a standard mounting platform for a desired attachment. However, heretofore, the process of mounting such accessories to the Picatinny rail has required the use of external tools, and has been both awkward and time-consuming. Moreover, the inability to timely attach a desired accessory to a firearm, or switch accessories, can be dangerous for the user. For example, in combat, a soldier's inability to quickly attach a bayonet to his or her firearm could result in death or serious injury to the soldier.

Consequently, there is a long felt need in the art for a device that enables a user to quickly and securely attach/detach an accessory (e.g., a scope, light, bayonet, etc.) to the Picatinny or tactical rail of a firearm without the use of external tools. There is also a long felt need for a device that is capable of being locked/unlocked with a single hand, thereby allowing the user to retain possession of the firearm with his or her remaining hand. Finally, there is a long felt need for a device that accomplishes all of the forgoing objectives, and that is relatively inexpensive to manufacture and safe and easy to use.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed herein, in one aspect thereof, is a device for enabling a user to quickly and securely attach/detach an accessory (e.g., a scope, light, bayonet, etc.) to the Picatinny or tactical rail of a firearm. In a preferred embodiment of the present invention, the device comprises a block portion, a locking pin, a spring, a locking disk and a button.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
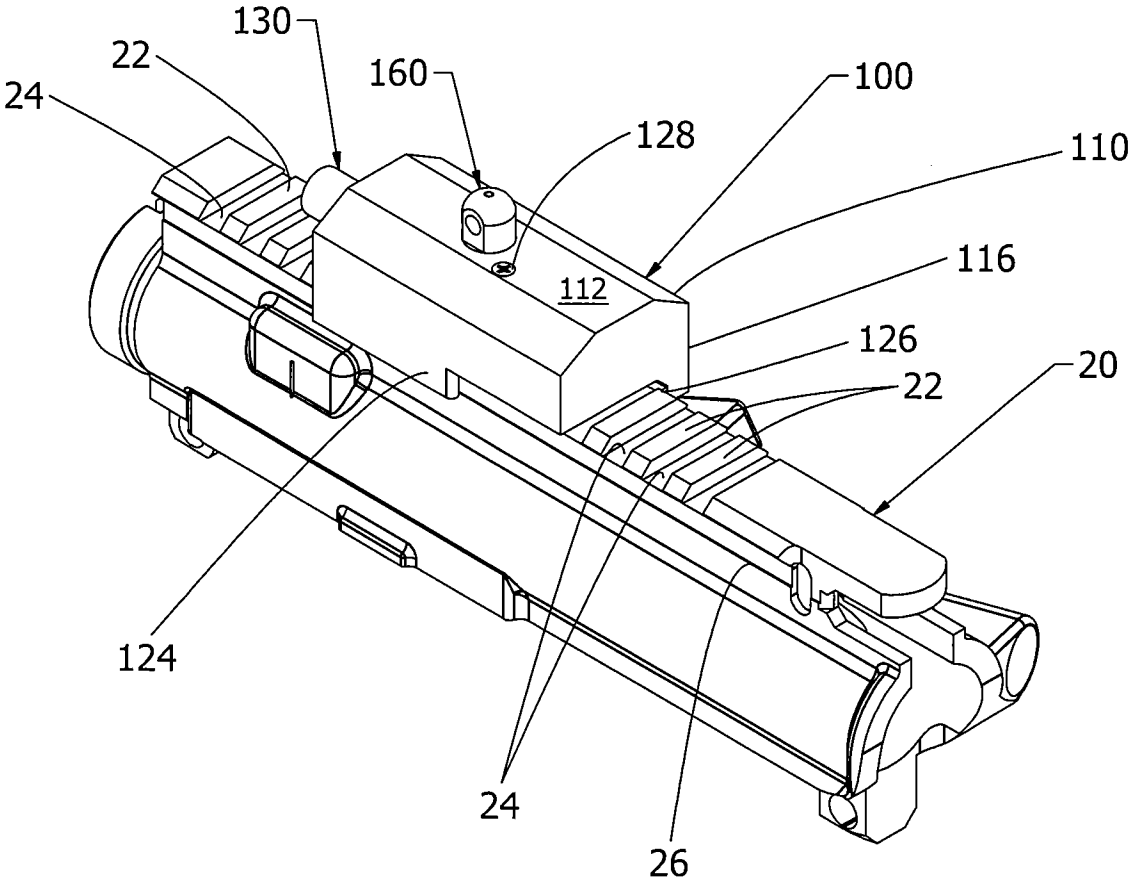
FIG. 1 is a perspective view of a preferred embodiment of the device of the present invention securely attached to a Picatinny rail of a firearm in a locked position.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details.

Referring initially to the drawings, FIG. 1 depicts a perspective view of a preferred embodiment of the swivel lock device 100 of the present invention in a locked position and securely attached to a Picatinny rail 20 of a firearm. By way of background, Picatinny rail 20 is an elongated bracket that may be attached to a firearm to provide a standard mounting platform for accessories and attachments such as a scope, light, bayonet and the like. Rail 20 is typically comprised of a plurality of raised spaced apart lugs or ridges 22 along its top or upper surface, with channels 24 located between and formed by said ridges 22, and a rail flange 26 extending along each side of rail 20.

Figure 2:
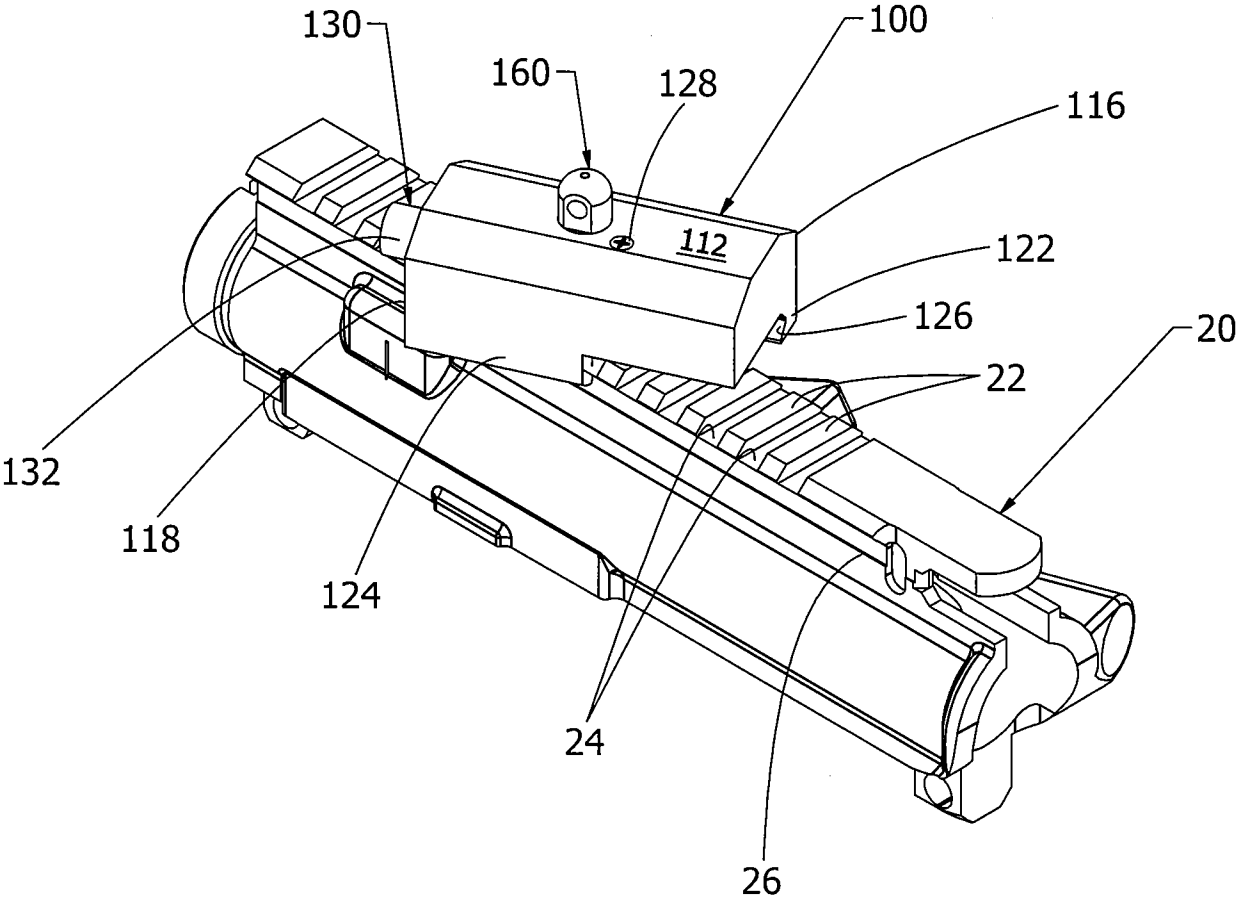
FIG. 2 is a perspective view of the device depicted in FIG. 1 atop a Picatinny rail of a firearm in an unlocked position.

FIG. 2 depicts a perspective view of a preferred embodiment of the swivel lock device 100 of the present invention in an unlocked position and unsecured to Picatinny rail 20. As depicted in FIGS. 3-8, the swivel lock device 100 of the present invention is preferably comprised of a block portion 110, a locking pin 130, a spring 140, a locking disk 150 and a button 160, as described more fully below.

Figure 3A:
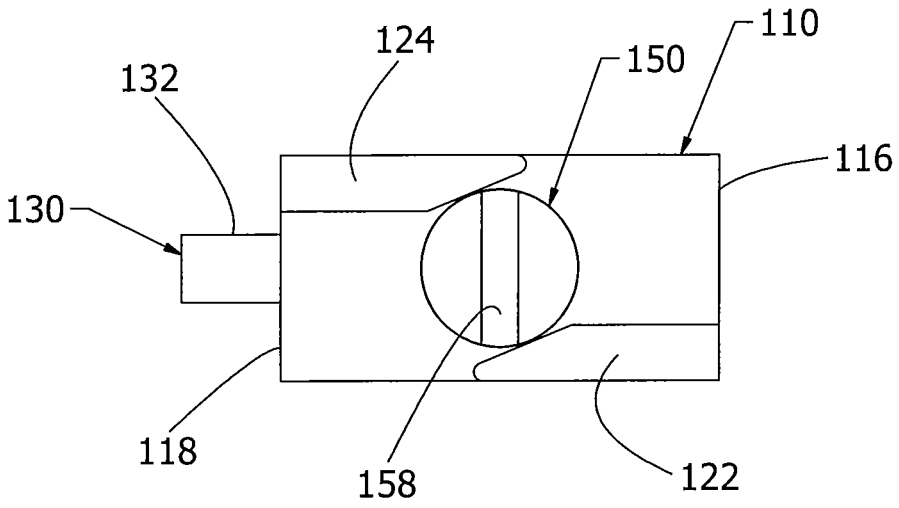
FIG. 3A is a bottom view of the device of FIG. 1 in a locked position.
Figure 3B:
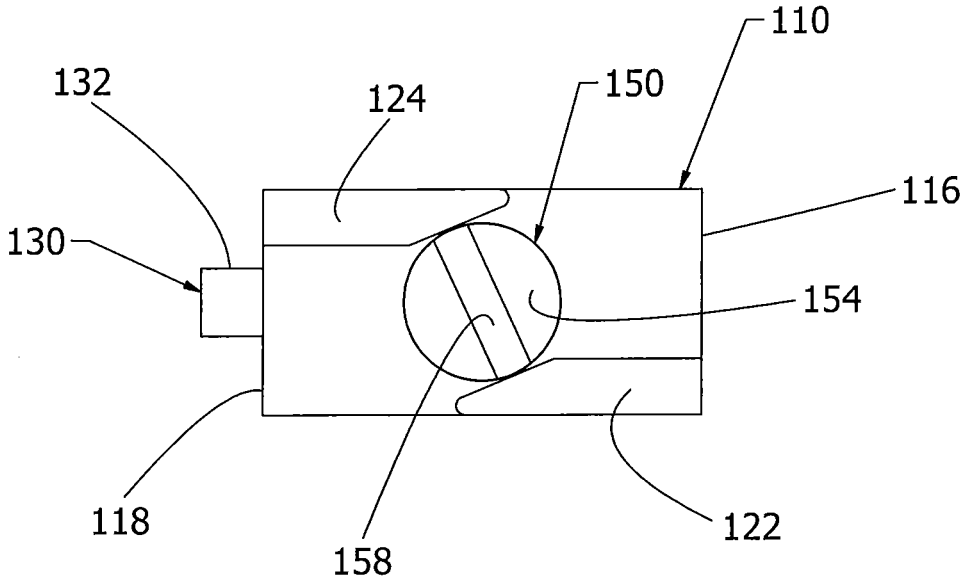
FIG. 3B is a bottom view of the device of FIG. 1 in an unlocked position.
Figure 7:
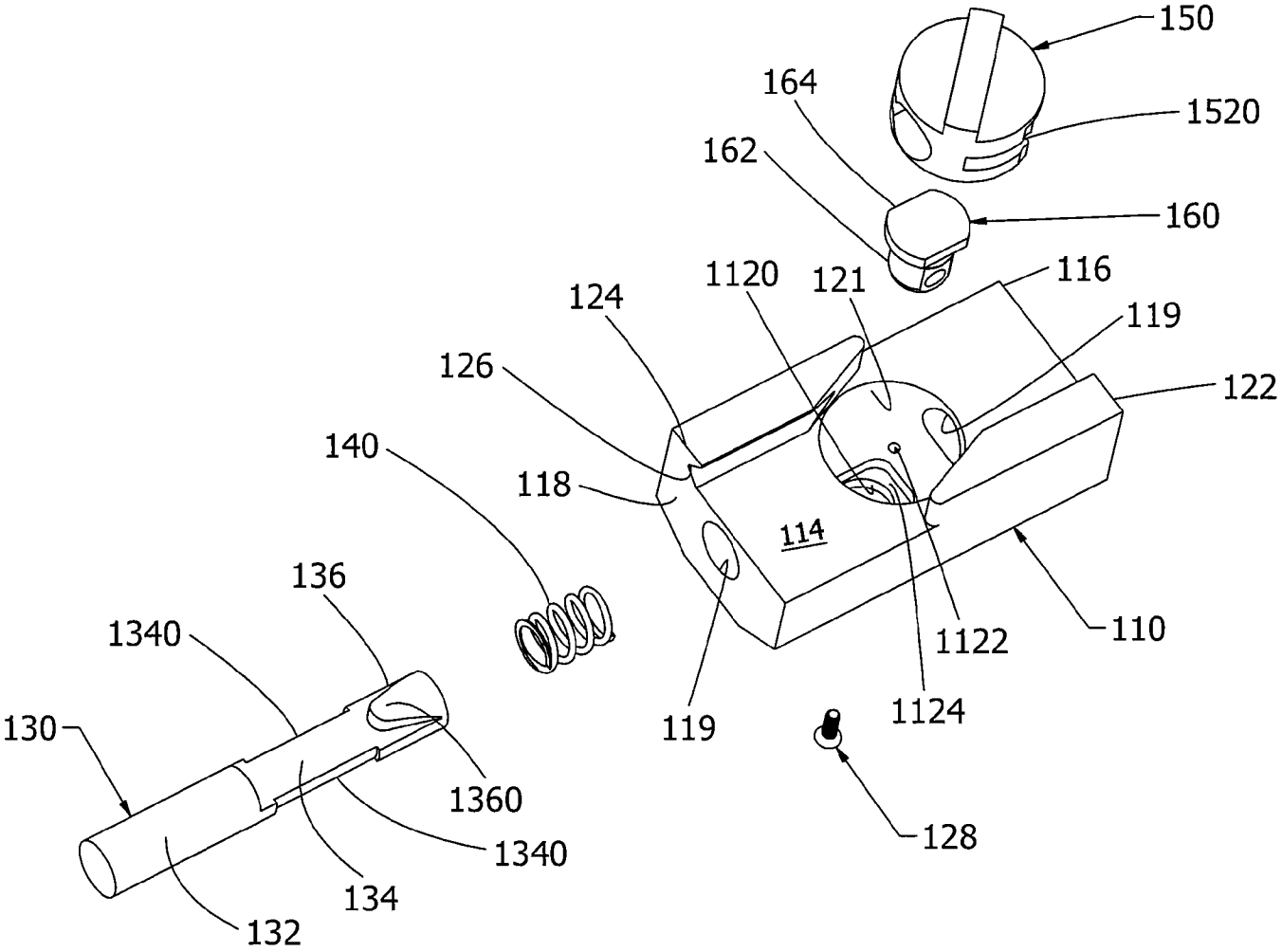
FIG. 7 is an exploded view of the device of FIG. 1.

As illustrated in FIGS. 1, 2 and 7, block portion 110 is preferably comprised of a top portion 112, a bottom surface 114, a front 116, a rear 118, a forward fence 122, a rear fence 124 and a screw 128. Block portion 110 has a length extending from the rear 118 to the front 116, and is further comprised of a vertical aperture 121 that extends transverse to the length of block portion 110 and a horizontal aperture 119 that extends from the rear 118 through vertical aperture 121 in a direction along the length of block portion 110. As described more fully below, horizontal aperture 119 is sized and shaped to receive spring 140 and slidably repositionable locking pin 130. Similarly, vertical aperture 121 is sized and shaped to receive a rotatably repositionable locking disk 150, as also described more full below. FIG. 3A is a bottom view of the device of FIG. 1 in a locked position, and FIG. 3B is a bottom view of the device of FIG. 1 in an unlocked position.

Top portion 112 of block 110 is further comprised of a first opening 1120, a second opening 1122 and a seat 1124 formed therein. Each of first opening 1120 and second opening 1122 extend through to vertical aperture 121, and seat 1124 is located adjacent to vertical aperture 121 and is larger in size that first opening 1120, as best shown in FIG. 7. As explained more fully below, each of first opening 1120 and seat 1124 is sized and shaped to receive a portion of button 160 and second opening 1122 is sized to receive screw 128.

As best illustrated in FIGS. 1-5 and 7, each of said forward fence 122 and rear fence 124 extend downwardly from said bottom surface 114 for mating engagement with rail 20. More specifically, rear fence 124 protrudes downwardly from one side of bottom surface 114 towards the rear 118 of block portion 110 and has a length that extends parallel to the length of block portion 110, but only partially along said length. Similarly, forward fence 122 protrudes downwardly from the opposite side of bottom surface 114 towards the front 116 of block portion 110 and has a length that extends parallel to the length of block portion 110, but only partially along said length as best shown in FIGS. 3 and 7. Each of rear fence 124 and forward fence 122 further comprise a generally v-shaped groove 126 extending along a substantial portion of the length of each of said rear and forward fences 124, 122 for mating engagement with rail flanges 26 of Picatinny rail 20.

Figure 4A:
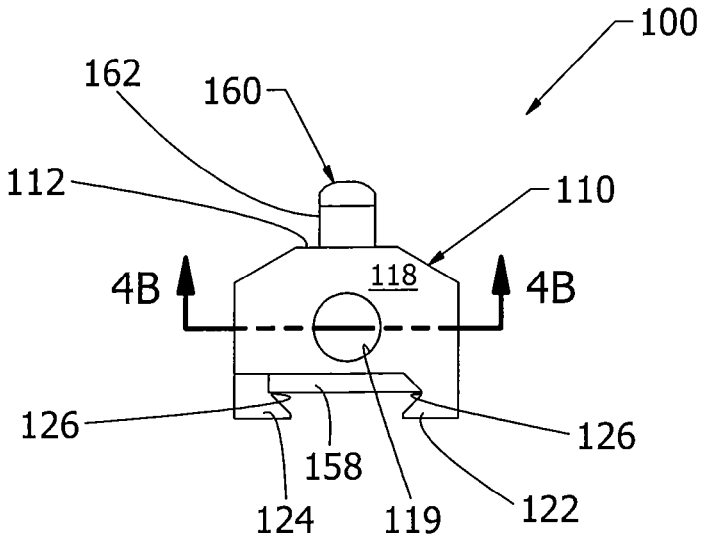
FIG. 4A is a rear elevational view of the device of FIG. 1 in a locked position.
Figure 4B:
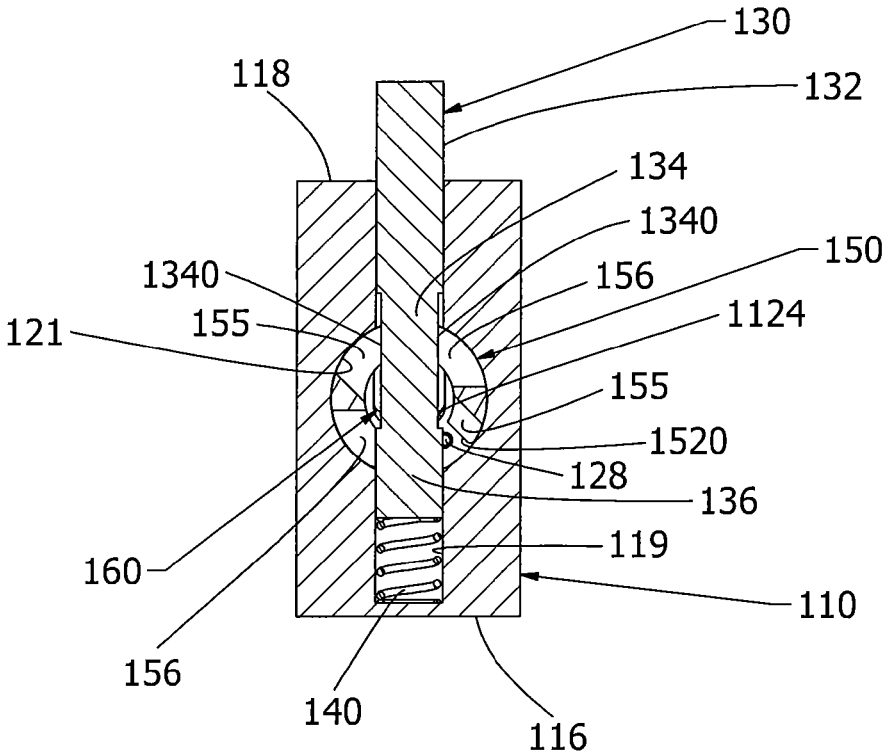
FIG. 4B is a cross-sectional view of the device of FIG. 4A at cut line 4B-4B.
Figure 5A:
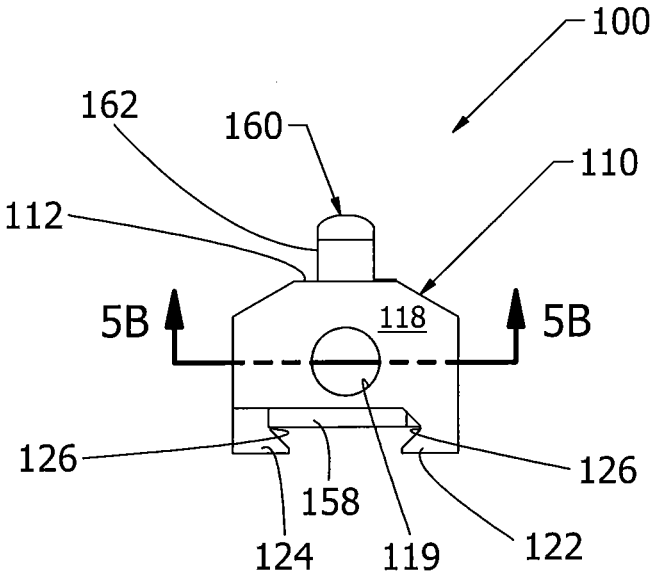
FIG. 5A is a rear elevational view of the device of FIG. 1 in an unlocked position.
Figure 5B:
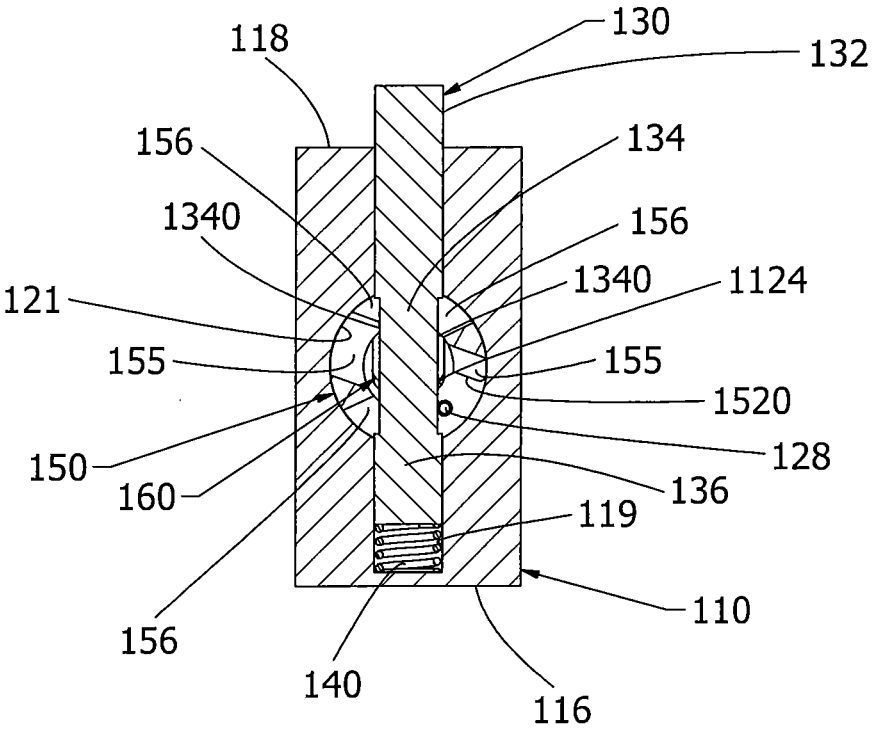
FIG. 5B is a cross-sectional view of the device of FIG. 5A at cut line 5B-5B.

As best illustrated in FIGS. 7 and 8, locking pin 130 is an elongated member comprised of a generally cylindrically shaped handle portion 132, a generally rectangular shaped body portion 134 and a pin catch portion 136, each of which is sized to be slidably repositioned within horizontal aperture 119 immediately adjacent to spring 140, which is also housed within horizontal aperture 119 as best shown in FIGS. 4B and 5B. More specifically, locking pin 130 is slidably disposed within horizontal aperture 119 of block portion 110 and through locking disk 150 which is rotatably positioned within vertical aperture 121, as described more fully below. Further, the end of pin catch portion 136 is in contact with spring 140 toward front 116 of block portion 110, and handle portion 132 extends outward from rear 118 of block portion 110 and horizontal aperture 119, as best shown in FIGS. 4B and 5B. Locking pin 130 is biased by spring 140 toward the rear 118 of block portion 110.

As previously stated body portion 134 is generally rectangular in shape and preferably comprised of opposing grooves 1340 that extend along a portion of the length of said body portion 134 between said handle portion 132 and said pin catch portion 136, as best shown in FIG. 7, which allow for additional rotational movement of locking disk 150. Pin catch portion 136 is preferably comprised of a pair of opposing ridges 1360 each further comprised of an angled portion 1362, as best shown in FIGS. 6, 7 and 8, for engaging a portion of locking disk 150 as more fully described below.

Figure 6A:
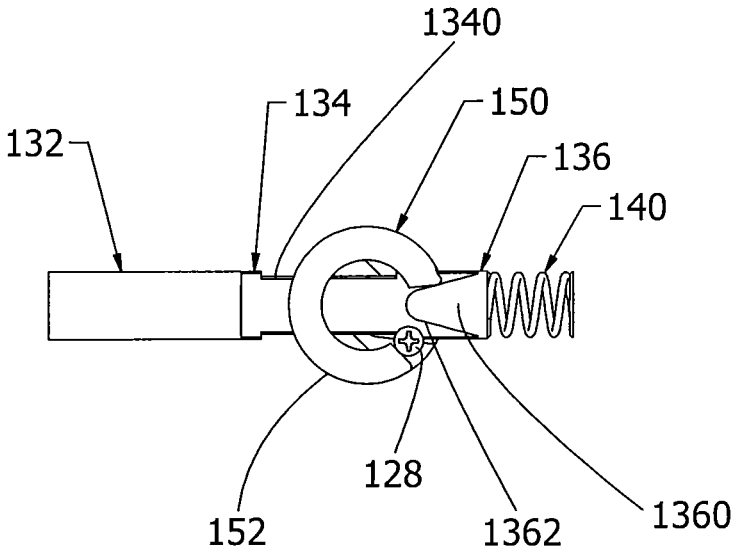
FIG. 6A is a top view of the locking pin, locking disk and spring of the device of FIG. 1 in a locked position.
Figure 6B:
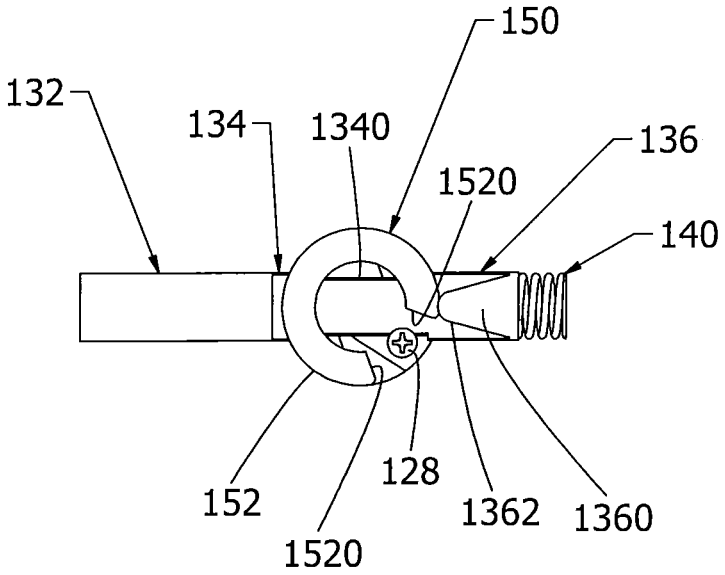
FIG. 6B is a top view of the locking pin, locking disk and spring of the device of FIG. 1 in an unlocked position.

Locking disk 150 is shaped and sized to be disposed and rotatably repositionable within vertical aperture 121, and is comprised of an upper portion 152, a lower portion 154, a continuous opening 155, a slot 156 positioned between said upper portion 152 and said lower portion 154 and adjacent to said continuous opening 155, and a key 158, as best shown in FIGS. 7 and 8. Upper portion 152 is generally circular in shape with an opening 1520 for receipt of one or more of screw 128 and ridge 1360 of pin catch portion 136 of locking pin 130, as best shown in FIGS. 6A and 6B, as device 100 is moved between a locked position (shown in FIG. 6A) and an unlocked position (shown in FIG. 6B). The positioning of screw 128 within opening 1520 helps to prevent the over rotation of block portion 110 about locking disk 150.

Figure 8A:
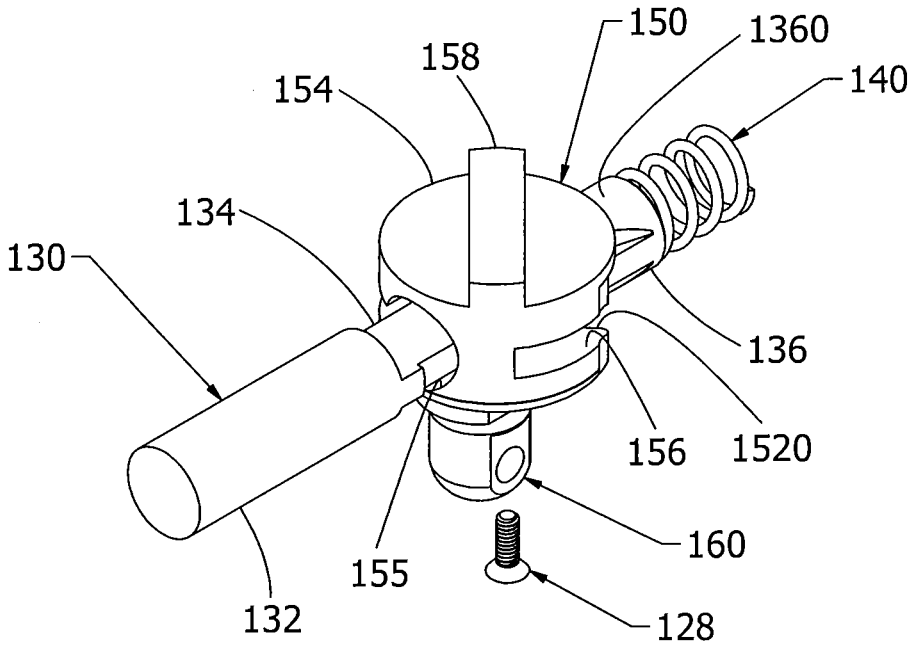
FIG. 8A is a bottom perspective view of the locking pin, locking disk, spring and button of the device of FIG. 1 in a partially assembled position immediately after the insertion of locking pin into locking disk.
Figure 8B:
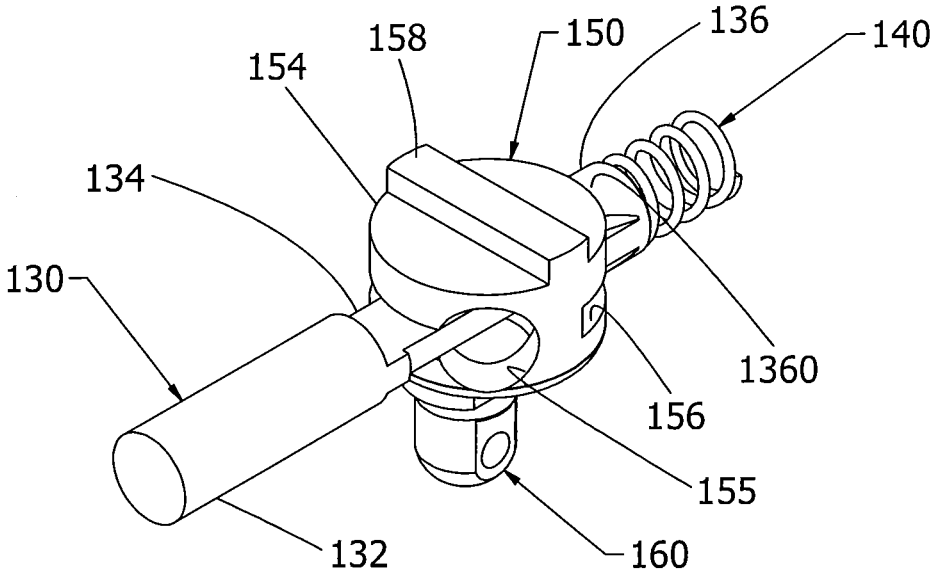
FIG. 8B is a perspective view of locking pin, locking disk, spring and button of the device of FIG. 1 in an assembled and locked position.

As best shown in FIG. 8A, continuous opening 155 extends through locking disk 150 and is sized and shaped to accommodate locking pin 130, which passes through said continuous opening 155. Similarly, slot 156 also extends through locking disk 150 adjacent to continuous opening 155 and is sized and shaped to accommodate body portion 134 of locking pin 130 as locking disk 150 rotates within vertical aperture 121 between an unlocked position (shown in FIG. 8A) and a locked position (shown in FIG. 8B).

Key 158 extends downwardly from lower portion 154 of locking disk 150 in the direction of rail 20, and at an angle from slot 156. In a preferred embodiment of the present invention, the angle between slot 156 and key 158 is between 20 and 40 degrees, though it is contemplated that other angles can also be employed. Key 158 is sized and shaped for mating engagement with a select one of said channels 24 between two of said ridges 22 of rail 20 to ensure a secure attachment between device 100 and rail 20.

Button 160 is preferably comprised of a head 162 and a larger body 164. Body 164 is shaped and sized to fit within seat 1124 and head 162 is shaped and sized to pass through first opening 1120 in top portion 112 of body portion 110. Button 160 is useful for mounting accessories to the firearm such as a bipod, vertical grip, etc.

FIG. 4A is a front elevational view of device 100 in a locked position, and FIG. 4B is a cross-sectional view of device 100 of FIG. 4A at cut line 4B-4B. Similarly, FIG. 5A is a front elevational view of device 100 in an unlocked position, and FIG. 5B is a cross-sectional view of the device of FIG. 5A at cut line 5B-5B. FIGS. 6A and 6B further display the mechanical interplay between locking pin 130, spring 140 and locking disk 150. More specifically, FIG. 6A is a top view of locking pin 130, spring 140 and locking disk 150 in a locked position, and FIG. 6B is a top view of locking pin 130, spring 140 and locking disk 150 in an unlocked position.

Having now described the general structure of a preferred embodiment of device 100, its function will now be described in general terms. A user (not shown) desiring to securely mount device 100 onto rail 20 would simply place device 100 (in an unlocked position) at a desired position along and on top of Picatinny rail 20 at a slight angle—meaning that the alignment of device 100 would be slightly offset (i.e., preferably less than) 45° from rail 20, as best shown in FIG. 2. The user would then depress handle portion 132 of locking pin 130 forward (i.e., in the direction of device 100) so that key 158 is disposed in a select one of channels 24 in rail 20 between two ridges 22. Block portion 110 is then rotated until the locking pin 130 is urged rearward (i.e., away from device 100 in the direction of handle portion 132) and ridge 1360 of pin catch portion 136 engages in opening 1520 of locking disk 150. When pin catch portion 136 is engaged with opening 1520, and body portion 134 is positioned within slot 156, block portion 110 is locked and prevented from rotating about locking disk 150 and each of forward fence 122 and rear fence 124 are securely engaged with a respective one of rail flanges 26, as best shown in FIG. 1.

Other variations are also within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A device for enabling a user to detachably mount an accessory on a Picatinny rail of a firearm device comprising:

a block portion further comprised of a vertical aperture and a horizontal aperture;

a locking pin;

a spring; and a locking disk, wherein said locking pin is slidably positioned within said horizontal aperture adjacent to said spring, and further wherein said locking disk is rotatably positioned within said vertical aperture and is comprised of an upper portion, a lower portion, an opening, a slot and a key.

2. The device of claim 1 further comprising a button.

3. The device of claim 1 wherein said locking pin is further comprised of a handle, a body portion and a pin catch portion.

4. The device of claim 1 wherein a portion of said locking pin is positioned within said opening when the device is in an unlocked position.

5. The device of claim 1 wherein a portion of said locking pin is positioned within said slot when the device is in an unlocked position.

6. A device for enabling a user to detachably mount an accessory on a rail of a firearm device comprising:

a block portion comprised of a vertical aperture and a horizontal aperture;

a locking pin comprised of a handle portion, a body portion and a pin catch portion;

a spring; and a locking disk comprised of a continuous opening, a slot and a key wherein said locking pin is slidably positioned within said horizontal aperture, and said locking disk is rotatably positioned along said locking pin and within said vertical aperture.

7. The device of claim 6 wherein said locking pin is positioned immediately adjacent to said spring.

8. The device of claim 6 wherein said locking pin is slidably repositionable within said horizontal aperture between a locked position and an unlocked position and is biased by said spring.

9. The device of claim 6 wherein said body portion of said locking pin is positioned within said continuous opening of said locking disk when the device is in an unlocked position.

10. The device of claim 6 wherein said body portion of said locking pin is positioned within said slot of said locking disk when the device is in a locked position.

11. The device of claim 6 further comprising a screw that passes through said block portion.

12. The device of claim 11 wherein said locking disk further comprises an upper portion with an opening therein, and further wherein said screw extends into said opening in said upper portion.

13. A device for enabling a user to detachably mount an accessory on a rail of a firearm device comprising:

a block portion comprised of a vertical aperture, a horizontal aperture, a forward fence and a rear fence;

a locking pin slidably positioned within said horizontal aperture and comprised of a handle portion, a body portion and a pin catch portion;

a spring positioned within said horizontal aperture adjacent to said locking pin; and a locking disk rotatably positioned within said vertical aperture along said locking pin and comprised of a continuous opening, a continuous slot and a key.

14. The device of claim 13 wherein said rail further comprises a pair of rail flanges and wherein each of said forward and rear fences are further comprised of a generally V-shaped groove for receipt of a respective one of said rail flanges.

15. The device of claim 13 wherein said body portion of said locking pin is positioned within said continuous opening of said locking disk when the device is in an unlocked position.

16. The device of claim 13 wherein said body portion of said locking pin is positioned within said continuous slot of said locking disk when the device is in an unlocked position.

17. The device of claim 13 further comprising a screw that passes through said body portion and extends into an opening in an upper portion of said locking disk to limit the amount of rotation of said locking disk relative to said block portion.

* * * * *